US006250263B1

(12) United States Patent
Sisco

(10) Patent No.: US 6,250,263 B1
(45) Date of Patent: Jun. 26, 2001

(54) DUAL PISTON CYLINDER CONFIGURATION FOR INTERNAL COMBUSTION ENGINE

(76) Inventor: Mark Sisco, P.O. Box 255, Exeter, CA (US) 93221

( * ) Notice: Subject to any disclaimer, the term of this patent is extended or adjusted under 35 U.S.C. 154(b) by 0 days.

(21) Appl. No.: 09/301,445

(22) Filed: Apr. 28, 1999

(51) Int. Cl.[7] ..... F02B 75/02
(52) U.S. Cl. ..... 123/51 R; 123/51 BA
(58) Field of Search ..... 123/51 R, 51 BA

(56) References Cited

U.S. PATENT DOCUMENTS

| | | | | |
|---|---|---|---|---|
| 530,523 | * | 12/1894 | Hirsch | 123/51 R |
| 952,706 | * | 3/1910 | Lucas | 123/51 BA |
| 1,090,650 | * | 3/1914 | Richardson | 123/51 BA |
| 1,533,004 | | 4/1925 | Henry . | |
| 2,085,270 | * | 6/1937 | Pavlecka | 123/51 BA |
| 2,886,018 | * | 5/1959 | Cuddon-Fletcher | 123/51 R |
| 2,896,596 | | 7/1959 | Abraham . | |
| 3,485,221 | | 12/1969 | Feeback . | |
| 4,037,572 | | 7/1977 | Franz . | |
| 4,244,338 | | 1/1981 | Rassey . | |
| 4,363,295 | | 12/1982 | Brandly . | |
| 4,554,894 | | 11/1985 | Johnson . | |
| 4,685,428 | | 8/1987 | Inagaki et al. . | |
| 4,759,319 | | 7/1988 | Merritt . | |
| 4,773,358 | | 9/1988 | Heath . | |
| 5,133,306 | | 7/1992 | Honkanen . | |
| 5,477,818 | | 12/1995 | Ascari et al. . | |
| 5,477,820 | | 12/1995 | Rao . | |
| 5,542,382 | | 8/1996 | Clarke . | |
| 5,560,326 | | 10/1996 | Merritt . | |
| 5,560,327 | | 10/1996 | Brackett . | |
| 5,596,955 | | 1/1997 | Szuba . | |
| 5,622,143 | | 4/1997 | Fuoss et al. . | |

* cited by examiner

*Primary Examiner*—Marguerite McMahon
*Assistant Examiner*—Jason Benton
(74) *Attorney, Agent, or Firm*—Heisler & Associates

(57) ABSTRACT

An internal combustion engine 10 is provided having at least one pair of cylinders 30, 31 which overlaps to form one enclosure 20. The two cylinders 30, 31 have central axes 2, 4 which are offset. The reciprocally-offset cylinders 30, 31 are joined to form the enclosure 20 with a centerline 26 perpendicular to the lateral central axes 2, 4 of the two cylinders 30, 31. Each cylinder 30, 31 is of generally uniform cross-section. The cylinders 30, 31 have central axes 2, 4 that are preferably generally parallel but not axially-aligned. The cylinders 30, 31 are connected to form an open cylinder connection pathway 42. Separate pistons 50, 51 are disposed within each cylinder 30, 31 with their crowns 52 facing each other and oriented toward the centerline 26. The crowns 52, in combination with the cylinder walls 32, form a shared combustion chamber 40 with shared intake valve 70, exhaust valve 90 and a means for ignition of combustible mixtures. The cylinders 30, 31 are reciprocally and vertically offset by a distance G such that the cross-sectional projection of each cylinder 30, 31 only partially overlaps the cross-sectional projection of the opposing cylinder 30, 31 by a distance H. The offset non-overlapping portion H provides sufficient surface 46 to mount intake and exhaust valves 70, 90 adjacent to the cylinders 30, 31 within the same cylinder block 22, 24.

20 Claims, 4 Drawing Sheets

DUAL PISTON CYLINDER CONFIGURATION FOR INTERNAL COMBUSTION ENGINE

FIELD OF THE INVENTION

The present invention relates to internal combustion engines and gas compressors which utilize pistons. More particularly, this invention relates to internal combustion engines and gas compressors whose pistons are disposed within at least two interconnected cylinders in a facing relationship such that the combination of the piston crowns and cylinder walls form a shared combustion chamber.

BACKGROUND OF THE INVENTION

Over the past several decades, substantial effort has been invested in the design and development of improved internal combustion engines. Design efforts have been, directed toward the creation of smaller, lighter engines with improved fuel efficiency and power. Engines have been characterized by their method of combustion, e.g., compression (diesel) or spark-ignited (gasoline). Further, engines are described and identified by the orientation and/or number of their pistons and cylinders, e.g., V-8, in-line 6, radial, Wankel rotary, horizontal and horizontally-opposed.

Internal combustion engines with horizontally-oriented pistons and cylinders have been the subject of much research over the past several decades. Their inherent low profile offers an opportunity to reduce engine size while maintaining fuel efficiency and power. Various countries have introduced several variations of both four cylinder and six cylinder horizontally-oriented engines.

A typical horizontally-oriented engine configuration includes multiple pairs of horizontal cylinders with a separate piston slidably disposed in each separate cylinder. The top or "crown" of each piston, in combination with the cylinder walls and a separate cylinder head, forms a unique, single combustion chamber. Each cylinder head, also provides a separate surface for intake and exhaust valve assemblies. In the case of spark-ignited engines, each cylinder head also provides a port for installation of some means for igniting the combustible mixture, usually a spark plug. For a typical horizontally oriented engine, each piston is connected to a common crankshaft.

During operation, a mixture of air and fuel is introduced into each combustion chamber. The mixture is then combusted, by either compression (diesel engines) or a spark (gasoline engines). When combusted, the energy generated by the exothermic expansion of the combustible mixture serves to drive the piston away from the cylinder head. In so doing, the piston's linear kinetic energy is delivered to the engine's crankshaft by a connecting rod rotatably attached to the piston. The crankshaft then delivers rotational power to the power train.

Several patents have offered modifications to the typical horizontally-oriented piston and cylinder configuration. Most notably, and of relevance to the present invention, is that prior art which teaches horizontally-oriented engine configurations with one combustion chamber shared between two or more pistons/cylinders. Generally, these types of engines are known as horizontally-opposed engines.

For example, Henry (U.S. Pat. No. 1,533,004) teaches an internal combustion engine with a combustion chamber shared between two cylinders. The shared combustion chamber is formed by the walls of two interconnected cylinders, the crowns of two opposing pistons which slidably reciprocate within the cylinders, and a single cylinder head. In addition to acting as a wall of the shared combustion chamber, the cylinder head provides a surface for intake and exhaust ports as well as spark plug access. In Henry, the pistons simultaneously converge toward each other and then simultaneously diverge away from each other during the various engine cycles.

Other patents, including most notably Feeback (U.S. Pat. No. 3,485,221), Rassey (U.S. Pat. No. 4,244,338), Johnson (U.S. Pat. No. 4,554,894) and Honkanen (U.S. Pat. No. 5,133,306) have proposed variations on the horizontally-opposed engine configuration. Each of the above include intake and exhaust valve assemblies which are located to the side of each cylinder pair. Consequently, as with Henry discussed above, these engines all require at least one separate cylinder head per cylinder pair.

Other relevant prior art teaches internal combustion engines with shared combustion chambers, but whose converging pistons are not horizontally-oriented. For example, Ascari (U.S. Pat. No. 5,447,818) teaches an engine with at least four cylinders that form two separate shared combustion chambers. Two cylinders and pistons are oriented at angles of approximately ninety degrees to each other, with the crown of each piston oriented toward a shared plane of symmetry. Ascari likens his engine to a "superimposed twin V." Again, the shared combustion chamber is formed by the cylinder wall, two piston crowns and a single cylinder head.

The prior art clearly evidences that the ability to reduce the overall size and weight of opposed piston engines with shared combustion chambers has been hampered by the need to include a suitable surface, i.e. a cylinder head, to accommodate the shared intake and exhaust valve assemblies. As previously indicated, in engines without shared combustion chambers, each cylinder has a cylinder head which provides a surface for the valve assemblies. Engines with shared combustion chambers have generally provided for the placement of the shared intake and exhaust valve assemblies in a separate "cylinder head-like" element that is separately bolted to the side of the cylinder blocks.

The present invention advances the prior art by eliminating the need for a separate cylinder head. Although the prior art teaches reduction in the number of required cylinder heads for dual piston/cylinder engine configurations from two to one, it still struggles with valve design and placement. The intake and exhaust valve assemblies are typically located between the ends of the dual cylinders to serve a common or shared combustion chamber. Consequently, this additional space requirement frequently limited the ability to bring the ends of the cylinders, and hence, the crowns of the pistons, closely together.

The patent to Rassey specifically teaches that "previous attempts to adapt poppet valves [in horizontally-opposed engines] have proven largely unsuccessful since the poppet valves cannot be positioned above the piston head as in the more conventional internal combustion engines."

Accordingly, a need exists for a cylinder/piston configuration of simple and reliable design which includes a combustion chamber shared between two horizontally-opposed cylinder/piston assemblies, yet allows the use of poppet valve assemblies to service the shared combustion chamber, while eliminating the need for a separate cylinder head to house the valve assemblies, thereby minimizing the size, weight and vertical profile of the engine for equivalent power requirements and providing for smoother, more efficient and less polluting operation.

SUMMARY OF THE INVENTION

The present invention provides an internal combustion engine with at least two cylinders that are disposed within the cylinder blocks. The cylinders have separate crank ends and separate face ends. One cylinder penetrates a first portion of the cylinder block; the other cylinder penetrates a second portion of the cylinder block. The two cylinders are joined at least partially in an overlapping manner, placing the cylinders in juxtaposition. The central axes of the opposing cylinders are offset from each other.

Separate pistons are disposed in the corresponding cylinders. The pistons are oriented so that their crowns face each other, hence, a shared combustion chamber is defined by the side walls of both cylinders in combination with the crowns of the opposing pistons. The offset between the central axes of opposing cylinders provides sufficient surface on face ends of the cylinders to mount intake and exhaust valve assemblies while still allowing both cylinders to communicate across an open cylinder connection pathway.

As proposed, the present invention eliminates the need for a separate cylinder head, as required in previous horizontally-opposed engine configurations. In the present invention, the cylinder block, in effect, acts as a "cylinder head."

Hence, the present invention provides a novel dual piston engine configuration that retains the known advantages of engines with shared combustion chambers yet, for equivalent engine power or efficiency, reduces overall size, simplifies manufacturing and assembly and enhances reliability.

OBJECTS OF THE INVENTION

Accordingly, a primary object of the present invention is to provide an opposed dual piston/cylinder internal combustion engine with cylinder pairs that are offset such that shared intake and exhaust valve assemblies may be immediately adjacent to each cylinder, thereby reducing the size and weight of the engine for equivalent power and fuel efficiency.

Another object of the present invention is to provide a dual cylinder shared combustion chamber internal combustion engine which will minimize the probability of pressure leaks from the shared combustion chamber, thereby increasing the reliability and efficiency of the engine while reducing the probability of engine failure.

Another object of the present invention is to provide an internal combustion engine with a shared combustion chamber whose geometric configuration enhances swirl of the combustible mixture, thereby providing more complete combustion and lowering pollutant levels caused by incomplete combustion.

Another object of the present invention is to provide an internal combustion engine with a shared combustion chamber whose compression ratio and power density can be increased by mounting the intake and exhaust valves facing the pistons within the cylinders, thereby reducing the distance between the crowns of the piston heads when they converge to their closest point prior to ignition.

Another object of the present invention is to provide an internal combustion engine with a shared combustion chamber that is easily assembled or disassembled for maintenance or overhaul.

Another object of the present invention is to provide an internal combustion engine with a combustion chamber shared between two facing pistons where the piston and cylinder's configuration may be replicated to create engines with multiple banks of piston and cylinder pairs to address varying power requirements for a particular engine application.

Another object of the present invention is to provide an internal combustion engine with a shared combustion chamber of simple and reliable manufacture from commonly available materials and components.

Another object of the present invention is to provide an internal combustion engine with a lower top-to-bottom profile, thereby allowing vehicles to be designed with corresponding lower profiles, providing lower aerodynamic drag and resulting in increased engine efficiency.

Another object of the present invention is to provide an internal combustion engine that is inherently balanced and hence, has low vibration while running.

Other further objects of the present invention will become apparent from a careful reading of the included drawing figures, the claims and the detailed description of the invention.

DESCRIPTION OF THE PREFERRED EMBODIMENT

Figure 1:
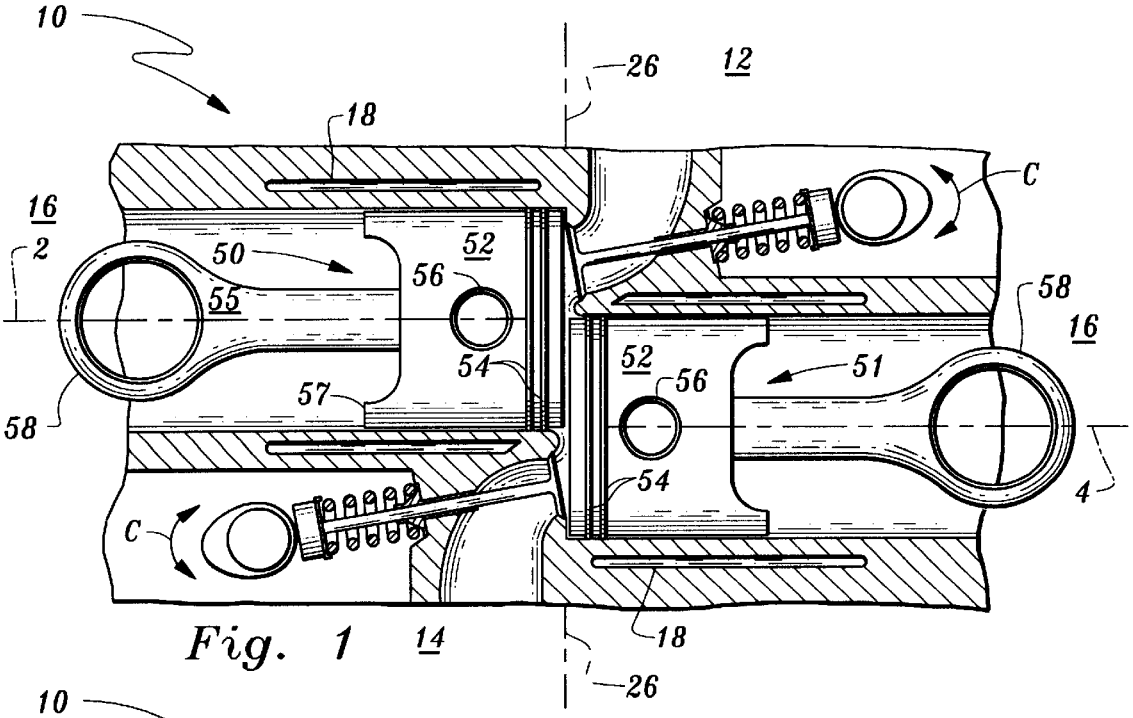
FIG. 1 is a cross-sectional side elevation of an engine block featuring an offset dual piston/cylinder shared combustion chamber according to this invention showing the cylinder blocks, cylinders and valve assemblies in section and the pistons not in section and with the pistons at top dead center and both intake and exhaust valves closed.

Referring to the drawings, wherein like reference numerals represent like parts throughout the various drawing figures, reference numeral 10 is directed to an internal combustion engine. The engine 10 has opposed and axially offset cylinders 30, 31 (FIG. 4) which together define a single enclosure 20. Facing piston assemblies 50, 51 (FIGS. 1–3) reciprocate within the cylinders 30, 31 to work with a shared combustion chamber 40 served by common valve assemblies 70, 90.

In essence, and with particular reference to FIGS. 1–4, the basic details of the engine 10 are described. The engine 10 includes at least one enclosure 20 (FIG. 4) formed by two interconnected cylinders 30, 31. The two cylinders 30, 31 are offset relative to each other so that crowns 53 of the piston assemblies 50, 51 (FIGS. 2 and 3) are not aligned together where the two cylinders 30, 31 are closest to each other. Separate facing piston assemblies 50, 51 are reciprocally driven within their separate cylinders 30, 31 by combustion within a shared combustion chamber 40. The shared combustion chamber 40 is served by common intake and exhaust valve assemblies 70, 90 which reciprocate within their respective ports 60, 80. The ports 60, 80 provide one form of a means to allow combustible mixtures to enter the shared chamber 20 and one form of a means to allow products of combustion to escape from the shared chamber 20. The valves 70, 90 open and close each port 60, 80 at designated times during a cycle of the engine 10.

More specifically, and with reference to FIGS. 1–4, details of the engine 10 are described. The engine 10 includes those additional ancillary components which are typical of internal combustion engines and which would be well known to those skilled in the art. Because these ancillary components are not unique to this invention and are well known in the art, a detailed description of these ancillary components has not been provided. Instead where reference is needed, they are referenced as "regions" around the engine 10 approximating where these components would be located.

As described, the engine 10 includes an intake manifold 12 which provides a means to enter combustible mixtures into the engine 10. The intake manifold 12 will generally be located on one side of the engine 10 to include components such as a carburetor, a fuel injection system and/or a turbocharger or supercharger system. The engine 10 also includes an exhaust manifold 14 which provides a means to remove any products of combustion from the engine 10. The exhaust manifold 14 is preferably located on a side of the engine 10 opposite the intake manifold 12. One skilled in the art would recognize that the location of the intake manifold 12 and exhaust manifold 14 can be modified to accommodate various engine 10 configurations, and that manifolds 12, 14 could also be commingled.

The engine 10 includes crank case regions 16 at both ends of the engine 10. The crankcase regions 16 enclose crankshafts and provide means to retain and distribute oil throughout the engine 10 for cooling and lubrication. Also, the engine 10 includes coolant voids 18 (FIG. 1) which penetrate the blocks 22, 24 to circulate coolant through the engine 10 to remove heat generated during the combustion process. Air cooled version are also viable. The two crankshafts would typically be timed to rotate together through a set of gears or other rotational coupling system. Vibration and torque generated by moving parts within the engine 10 would tend to be minimized by the opposite crankshafts rotation.

The engine 10 includes the first half cylinder block 22 and the second half cylinder block 24 which are joined together at a centerline 26. Externally, the blocks 22, 24 are connected to those ancillary engine 10 components described above which are common to internal combustion engines. The two half cylinder blocks 22, 24 can be separate or formed from a unitary mass of material.

The cylinder half blocks 22, 24 are penetrated by separate cylinders 30, 31. Each cylinder 30, 31 has separate central axes 2, 4. As shown, the cylinder 30 penetrates the upper portion of the first half cylinder block 22. The cylinder 31 penetrates the lower portion of the second half cylinder block 24. The blocks 22, 24 and cylinders 30, 31 are mated at the centerline/seam 26 to form the enclosure 20. The seam 26 preferably extends between the blocks 22, 24 where they are joined. The plane containing the seam 26 intersects the extended central axes 2, 4 of both cylinders 30, 31.

The cylinders 30, 31 preferably have substantially constant circular cross-sections which penetrate and extend uniformly through each cylinder block 22, 24 along their separate central axes 2, 4. Although shown as circular, the cross-sectional shapes of the cylinders 30, 31 can be varied to accommodate various shapes of pistons. The cylinders 30, 31 preferably have equivalent bore diameters F. The separate cylinder central axes 2, 4 are preferably parallel and generally perpendicular to the plane containing the seam 26. The left and right cylinders 30, 31 are reciprocally offset from one another, hence, the cylinder axes 2, 4 are not axially aligned.

Figure 4:
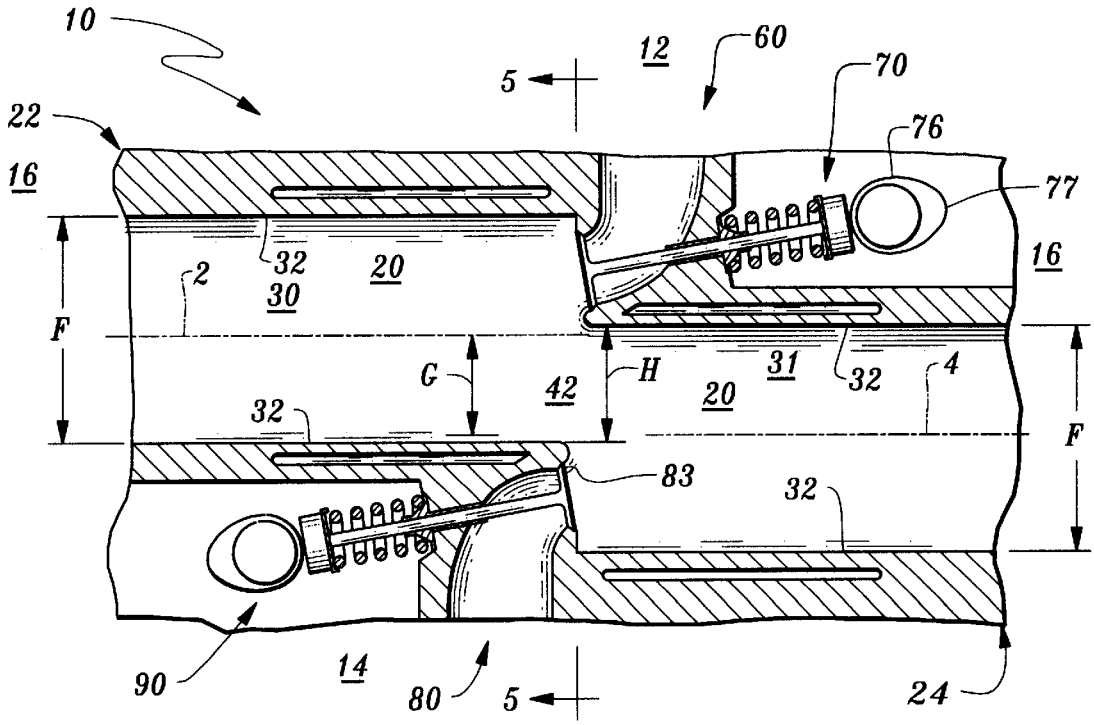
FIG. 4 is a cross-sectional side elevation of this invention showing the cylinder blocks and valve assemblies, with the piston assemblies removed for clarity.
Figure 5:
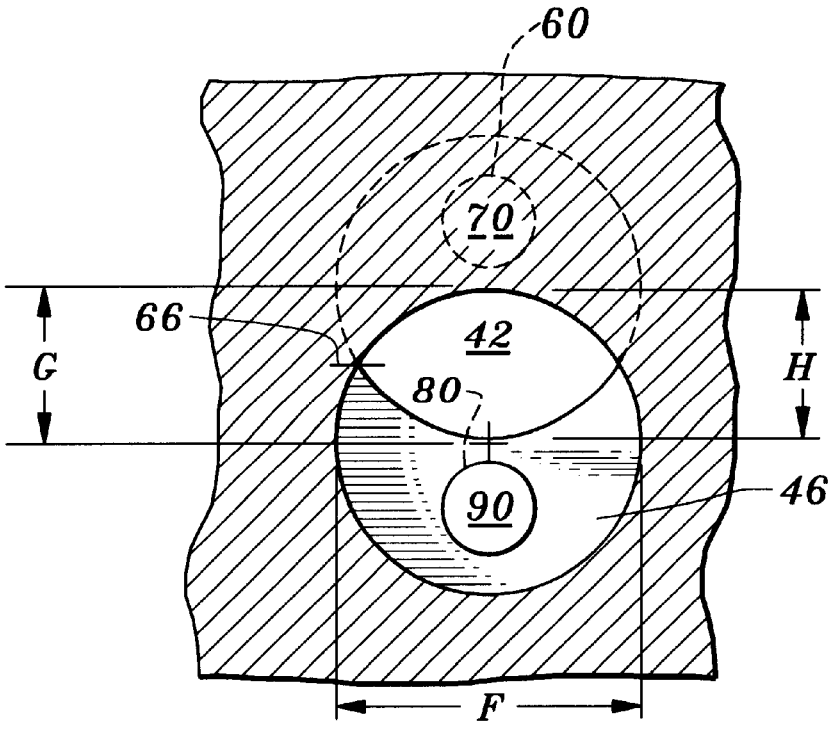
FIG. 5 is a cross-sectional end view of the present invention taken along line 5—5 of FIG. 4 and depicting the overlapping and offset cylinder bores with one valve and port included in each cylinder.
Figure 6:
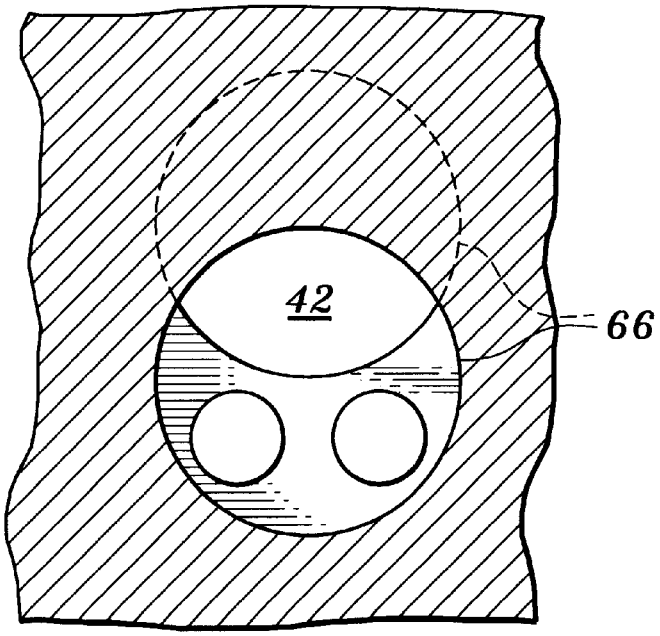
FIG. 6 is an alternative embodiment of that which is shown in FIG. 5, showing two valve ports per cylinder.
Figure 7:
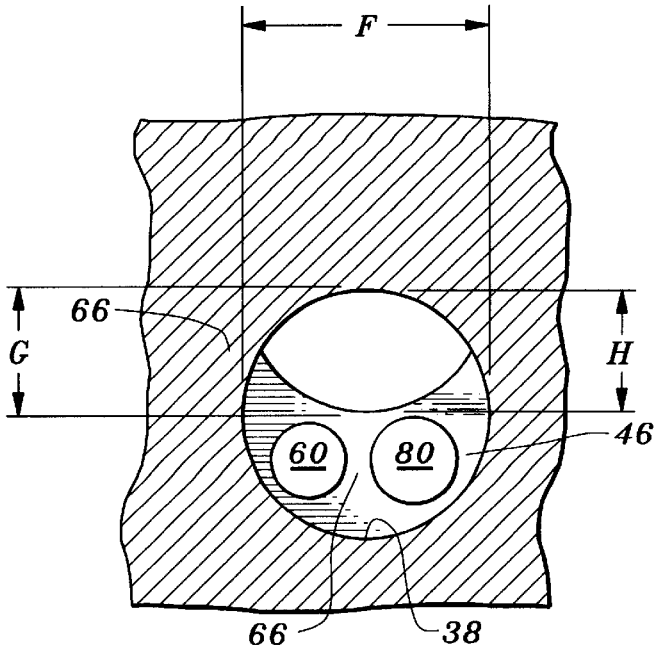
FIG. 7 is an alternative embodiment of that which is shown in FIG. 5, where the diameter of one valve port is greater than that of another valve port.
Figure 8:
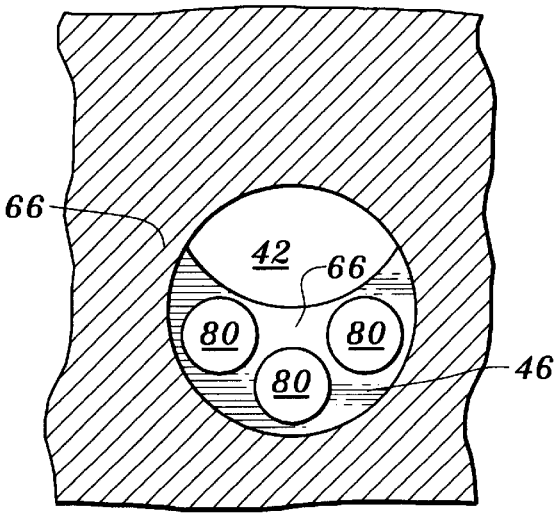
FIG. 8 is an alternative embodiment of that which is shown in FIG. 5, showing three valve ports per cylinder.
Figure 9:
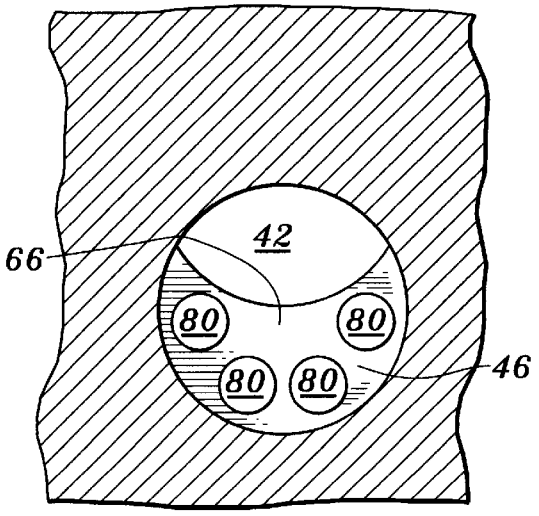
FIG. 9 is an alternative embodiment of that which is shown in FIG. 8, showing four valve ports per cylinder.

As shown in FIGS. 4 and 5, the cylinders 30, 31 are offset by a distance G which is the distance between the cylinder central axes 2, 4. The offset distance G is preferably less than the cylinder bore diameter F. One skilled in the art would recognize that the offset distance G between the axes 2, 4 of the cylinders 30, 31 may be varied to accommodate multiple different engine 10 configurations. The cylinder bore diameter F can also be varied.

As most clearly shown in FIGS. 4 and 5, since the offset distance G is preferably less than the bore diameter F, a portion of the projected cross-sections of the cylinders 30, 31 partially overlap by a distance H. The prior art teaches engines with cylinders whose cross-sectional areas are fully overlapping without any offset. As will be shown below, the cylinder offset G provided in the present invention, which causes partial overlap H, is distinctive from the prior art and provides additional surface 46 which will successfully accommodate the installation of intake and exhaust valve assemblies 70, 90. This overlap H creates an open cylinder connection pathway 42. The open cylinder connection pathway 42 provides one form of a means to provide flow between the cylinder 30 and the cylinder 31, forming an integral portion of the shared chamber 40.

Since both cylinders 30, 31 are reciprocally offset, two non-overlapping portions of the projected cross-sections of both cylinders 30, 31 are also created. The area of the non-overlapping portions varies depending on the offset distance G and the bore diameter F. These non-overlapping portions provide valve surface 46 (FIGS. 5-8). The valve surface 46 are located adjacent to each cylinder 30, 31 and integrated within each cylinder block 22, 24. One skilled in the art would recognize that this surface 46 may interchangeably accommodate intake or exhausts ports 60, 80. However, for clarity in description of the present invention, the intake surface is identified as that surface adjacent to the cylinder 31 in block 24. Commensurately, the exhaust surface 46 is identified as that which is adjacent to the cylinder 30 in block 22.

Hence, by virtue of the cylinder offset G and the resulting creation of opposing valve surface 46, the limitations on valve placement above each piston and cylinder encountered by the prior art is resolved. The valve surface 46 support valve assemblies adjacent each cylinder.

A separate one of the piston assemblies 50, 51 is disposed to linearly reciprocate within each cylinder 30, 31. Each piston assembly 50, 51 includes a piston head 52 which is generally cylindrical in shape and closely conforms to the profile of its respective cylinder 30, 31. The diameter of each head 52 is less than the bore diameter F so that the piston assemblies 50, 51 can slidably reciprocate within the cylinders 30, 31. Each piston head 52 has a crown 53 which provides a face upon which the pressure forces created by combustion can act. The piston heads 52 are oriented within the cylinders 30, 31 such that their crowns 53 face each other and are generally parallel, thereby creating the terminal, but movable, ends of the shared chamber 40. Compressible circumferential rings 54 encircle each piston head 52 near its crown 53. The rings 54 serve to enhance separation of the combustion chamber 40 area from the crankcase regions 16. The rings 54 expand to fill any remaining gap between the piston head 52 and the cylinder walls 32.

Separate connecting rods 55 are attached to each piston head 52 by a wrist pin 56. The wrist pin 56 penetrates both the piston head 52 and the head end of the connecting rod 55. The crank end 58 of the connecting rod 55 is connected to a crankshaft mounted in the crankcase region 16 in the usual manner. The linear reciprocating motion of each piston head 52 is converted to rotational motion by attachment of the piston head 52 via the connecting rod 55 to the crankshaft. The provision of the opposing linear forces and counter-rotational torques serve to dynamically balance the engine 10 of the present invention to lessen engine vibration.

Figure 2:
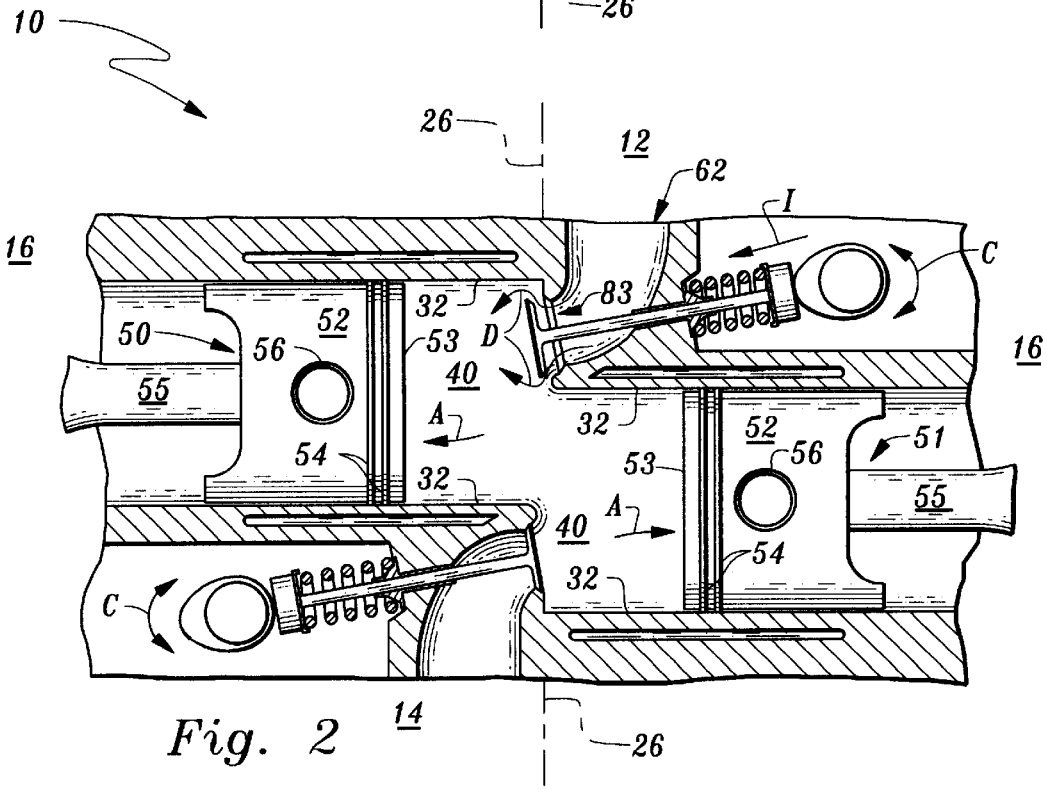
FIG. 2 is that view shown in FIG. 1 but during the engine's induction stroke with the pistons shown diverging from a central plane and with an intake valve opened to allow a combustible mixture to enter the shared combustion chamber.
Figure 3:
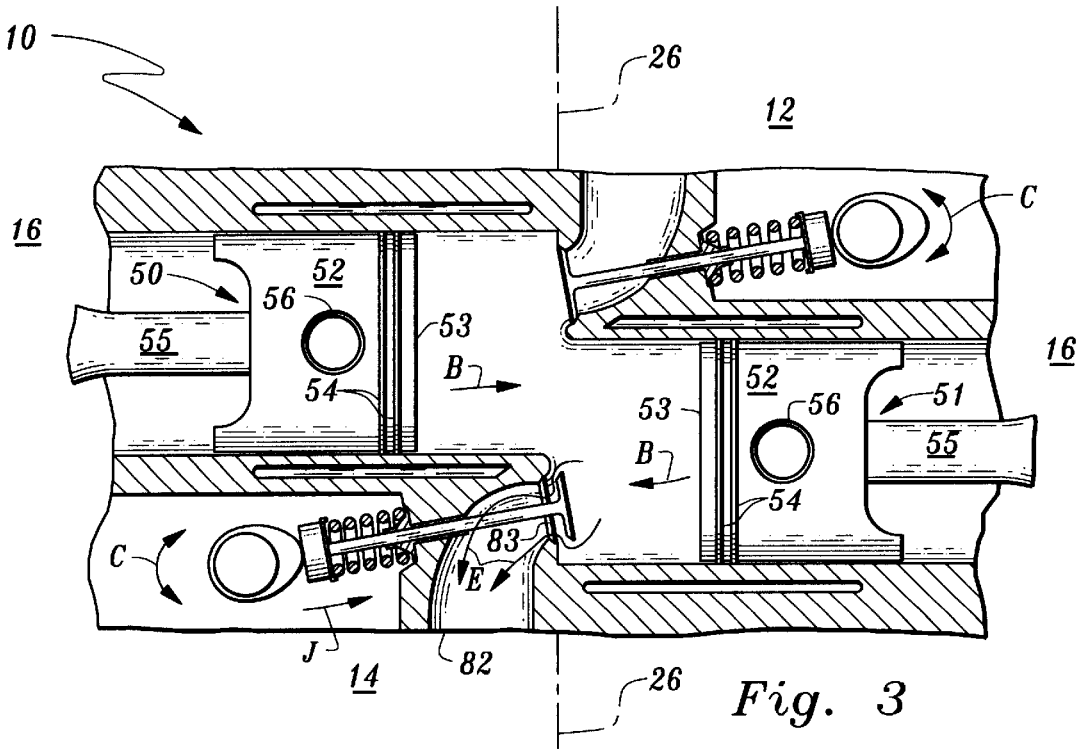
FIG. 3 is that view shown in FIG. 1 during the engine's exhaust stroke with the pistons shown converging toward a central plane with the intake valve closed and the exhaust valve opened to allow the combustion products to be expunged from the shared combustion chamber.

At least one intake valve 70 (FIG. 5), penetrates the intake surface. An exhaust valve 90 penetrates the exhaust surface 46. The intake port 60 provides a means for fluid communication between the shared combustion chamber 40 and intake manifold 12 (FIG. 2). The exhaust port 80 provides a means for fluid communication between the shared combustion chamber 40 and exhaust manifold 14 (FIG. 3). The intake and exhaust surfaces of each cylinder are interchangeable or commingleable on the same surface.

As shown in FIGS. 1–4, the configuration of the present invention described here includes an intake valve assembly 70. The intake valve 70 opens at the appropriate time during an engine cycle to allow flow into the shared chamber 40. One skilled in the art would recognize that the shape and size of the lobe 77 on the cam 76 may be varied to modify the performance characteristics of the engine 10 of the present invention. One skilled in the art would further realize that the valve 70 actuated by means other than a direct cam and lobe 76, 77 configuration, such as a push rod system.

As shown in FIG. 5, the exhaust surface 46 is located in the half cylinder block 22. The exhaust surface 46 is penetrated by an exhaust port 80 (FIG. 5) through which products of combustion are released from the shared chamber 40. The products of combustion, which are typically gases, exit past the exhaust valve 90 through valve seat 83 and the exhaust port 80 to the exhaust manifold region 14.

Functionally, as indicated, the exhaust valve 90 provides a means for products of combustion to escape from the shared chamber 40. Hence, the exhaust valve 90 is only open during the exhaust stroke of the engine 10.

In use and operation, the engine 10 may be operated in various cycle modes, e.g., two-cycle, four-cycle, or more and with different fuel, such as gasoline, diesel, natural gas, etc. In addition, as shown in FIGS. 6–9, the engine 10 may use two or more intake and exhaust ports 60, 80, to accommodate various engine applications and performance requirements. For clarity, the operation of the engine 10 is described in a four-cycle mode with only one intake valve 70 and one exhaust valve 90. The four cycle mode includes an induction stroke, a compression stroke, a power stroke and an exhaust stroke. The description of the operation of the engine 10 of the present invention begins with the induction stroke.

As shown in FIG. 1, just prior to the beginning of the induction stroke, both piston assemblies 50, 51 are closest to each other and the seam 26. In addition, both the intake valve 70 and the exhaust valve 90 are closed. During the intake stroke of the present invention, both piston assemblies 50, 51 diverge within their respective and interconnected cylinders 30, 31 to move laterally (in a direction represented by Arrow A in FIG. 2) away from the seam 26 of the enclosure 20, thereby increasing the volume and correspondingly reducing the pressure within the shared combustion chamber 40. The variable volume of the shared combustion chamber 40 is defined by the location of the crowns 53 of the piston heads 52 as they diverge from each other within their respective cylinders 30, 31.

Concurrent with the divergence of piston assemblies 50, 51, the intake valve 70 opens (Arrow I) to allow combustible mixtures, e.g., fuel and air, to travel from the intake region 12, through the intake port 60 and around the intake valve 70 (Arrows D) to enter the shared combustion chamber 40. The intake valve 70 is opened by the action of the rotating cam 76 and its eccentric lobe 77. The rotation of the camshaft, to which the cam 76 is attached, is synchronized with the rotation of the crankshaft so that the intake valve 70 or the exhaust valve 90 opens and closes at proper times during an engine cycle. One skilled in the art will recognize that the camshaft can be synchronized with the crankshaft in the usual manner via timing gears, belts or chains.

Once the piston assemblies 50, 51 reach the end of their divergent travel toward their opposing crankcase regions 16, the shared combustion chamber 40 has been filled with the combustible mixture, e.g., gasoline and air. The compression stroke then begins.

With both the intake valve 70 and the exhaust valve 90 closed, the piston assemblies 50, 51 converge linearly within their respective cylinders 30, 31. As the piston heads 52 converge, the volume of the shared combustion chamber 40 decreases (Arrow B, FIG. 3), compressing the combustible mixture. As shown in FIG. 1, once the pistons 50, 51 have reached the end of their convergent travel toward the centerline 26, the volume of the shared combustion chamber 40 is substantially reduced and the combustible mixture is compressed and subjected to much greater pressure.

With the piston assemblies 50, 51 at or near top dead center and both the intake valve 70 and the exhaust valve 90 in closed positions, the power stroke is initiated. If the combustible mixture is gasoline and air, ignition is typically provided by means of an electric spark from a spark plug. The spark plug can be located in one of the spark plug/sensor/injector regions 66 on surface 46 or other adjacent areas such as the intake surface. Alternatively, one or more spark plugs can be located at the various regions 66. If the mixture is diesel vapor, direct injection or precombustion chamber, then ignition is caused by compression alone.

As shown in FIG. 2, after ignition, the fuel/air mixture combusts, causing rapid expansion of combustion gases which explosively increase the pressure in the shared combustion chamber 40, simultaneously driving both piston assemblies 50, 51 away from each other (in a direction along Arrows A). The pressure of the combustion gases within the share combustion chamber 40 creates a driving force directed against the area of both crowns 53 of both pistons 52 simultaneously. Since, the greatest percentage of area within the shared combustion chamber 40 exposed to the pressure of combustion at the outset of the power stroke is that of the two piston crowns 53 versus two piston crowns and a separate cylinder head, as in prior dual piston/cylinder engine configurations, the bulk of the explosive energy is converted to kinetic energy in the piston assemblies 50, 51.

The power generated by combustion is first converted into the linear motion of the pistons 52. The linear motion of the pistons 52 is then translated into rotational motion at the crankshaft. This translation is accomplished by the action of the connecting rod 55 which oscillates on the wrist pin 56 in the piston head 52, while simultaneously connected at its crank end 58 to the crankshaft.

Once the diverging piston assemblies 50, 51 have reached the end of their travel away from each other toward their respective crankcase regions 16, the power stroke ends and the exhaust stroke begins. As shown in FIG. 3, the exhaust valve 90 opens (Arrow J) and both piston assemblies 50, 51 converge toward each other and the centerline 26. The combustion products exit (Arrows E) from the shared combustion chamber 40, around the exhaust valve 90, through the exhaust port 80 to the exhaust manifold 14. During the exhaust stroke, the piston assemblies 50, 51 are carried toward each other by rotational forces remaining in the crankshaft system. These rotational forces may be the result of energy in a flywheel and/or energy supplied by an additional bank of dual pistons in their power stroke and connected to the common crankshafts. As the piston assemblies 50, 51 continue to converge toward the centerline 26, the volume of the shared combustion chamber 40 continues to decrease, thereby maintaining a positive pressure differential between the shared combustion chamber 40 and the exhaust port 80. Once the piston assemblies 50, 51 have fully converged toward the centerline 26, the exhaust valve 90 closes, the intake valve 70 opens and the pistons 50, 51 once again diverge within their respective cylinders 30, 31, beginning a new induction stroke.

Although shown as a single pair of cylinders, the two cylinders 30, 31 of the present invention could be part of a four, six, eight or more piston/cylinder engine. Where multiple banks of the present invention are incorporated in a single engine, each cylinder set is timed to smooth out the engine's performance by delivering each power stroke in sequential series to the connected crankshafts.

Additionally, with reference to FIGS. 5–8, alternative intake and exhaust port 60, 80 arrangements may be used depending on the needs of the specific engine's application. These figures illustrate some possible port 60, 80 configurations and numbers of ports but not the only possible port 60, 80 configurations.

Although shown as parallel, the cylinders 30, 31 of the present invention may be offset and interconnected, but with their central axes 2, 4 oriented in a non-parallel manner. Also, while shown with only two cylinders in a horizontal fashion, the engine 10 can have cylinder pairs in any orientation and could include 2, 3, 4, 5, 6 or more cylinder pairs, depending on the performance requirements and other requirements of the engine 10.

Additionally, the cylinder/piston configuration of the present invention may be utilized in non-combustion engine applications, such as for gas compressors or positive displacement pumps. In these alternative embodiments, work will be input to the system to drive both piston assemblies 50, 51 within their respective cylinders 30, 31 to compress or displace fluids, liquids or a combination of both gaseous and liquid fluids.

When configured as a compressor or positive displacement pump, the shared combustion chamber 40 acts as a compression chamber or fluid cavity, respectively. In these configurations, the pistons 50, 51 diverge to allow fluids to enter the chamber 40 via an intake mechanism. The pistons 50, 51 then converge toward each other compressing the gas or displacing the liquid out an exhaust/outlet mechanism to a gas or liquid pipeline.

One skilled in the art will recognize that various elements of the present invention, e.g., pistons, valve assemblies, exhaust and intake manifolds, crankcase assemblies and camshaft assemblies can be made from commonly available materials. One skilled in the art will further recognize that the specific design of these well-known elements is infinitely variable to accommodate the intended use of the specific engine. Further, it is readily understood that many of the individual elements of the engine may be purchased as components from several different manufacturers excluding possibly the block or block assemblies. Consequently, one skilled in the art will be able to readily modify these elements to provide an engine with appropriate power, fuel efficiency, weight, size or reliability for an intended application. For clarity, details associated with these well-known elements and variations on such elements have not been addressed in this description.

This disclosure is provided to reveal a preferred embodiment of the invention and a best mode for practicing the invention. Having thus described the invention in this way, it should be apparent that various different modifications can be made to the preferred embodiment without departing from the scope and fair meaning of this disclosure.

What is claimed is:

1. An internal combustion engine, comprising in combination:

at least two cylinders, each said cylinder having separate crank ends, separate face ends and separate central axes;

said separate face ends located closer to each other than a distance between said separate crank ends;

said face ends of said at least two cylinders having an open cylinder connection pathway there between;

at least two pistons, one piston located in each of said at least two cylinders;

each said piston configured to reciprocate within one of said cylinders; wherein said separate central axes of said at least two cylinders are oriented offset from each other; and wherein said face ends of each of said at least two cylinders include surfaces thereon on portions thereof which are not defined by said open cylinder connection pathway, said surfaces including a first surface at least partially facing one of said at least two cylinders.

2. The engine of claim 1 wherein said separate central axes are oriented substantially parallel to each other.

3. The engine of claim 2 wherein said at least two cylinders have a cylinder diameter and an offset distance between said separate central axes, such that said face ends of said cylinders overlap each other.

4. The engine of claim 1 wherein said face ends of each of said at least two cylinders are each adjacent to each other and to a central plane.

5. The engine of claim 1 wherein each said face end includes at least one port taken from the group of ports including reactant inlet ports, and exhaust outlet ports; and wherein said ports are located on portions of said face ends separate from said open cylinder connection pathway.

6. The engine of claim 5 wherein said pathway has a length shorter than a width of a smallest of said ports located on said face ends.

7. The engine of claim 5 wherein at least one of said ports at least partially faces at least one of said cylinders.

8. The engine of claim 7 wherein each said port at least partially faces at least one of said cylinders.

9. The engine of claim 1 wherein said pistons travel into a majority of a space defining said pathway when said pistons are at a point closest to said face ends of said cylinders.

10. The engine of claim 1 wherein said pathway has substantially no length between said cylinders.

11. An internal combustion engine, comprising in combination:

at least two cylinders, each said cylinder having separate crank ends, separate face ends and separate central axes;

said separate face ends located closer to each other than a distance between said separate crank ends;

said face ends of said at least two cylinders having an open cylinder connection pathway there between;

at least two pistons, one piston located in each of said at least two cylinders;

each said piston configured to reciprocate within one of said cylinders;

wherein said separate central axes of said at least two cylinders are oriented offset from each other; and wherein said face ends of each of said at least two cylinders include surfaces thereon on portions thereof which are not defined by said open cylinder connection pathway, said surfaces including a first surface facing one of said at least two cylinders and a second surface facing the other of said at least two cylinders.

12. An internal combustion engine, comprising in combination:

at least one enclosure, said enclosure including at least two cylinders, said enclosure including means to allow flow between said at least two cylinders, said flow allowing means including an open cylinder connection pathway between said at least two cylinders, said pathway passing through portions of said face ends of said cylinders separate from said face end surfaces;

each said cylinder having a separate face end, each said face end having a surface at least partially facing one of said cylinders;

at least one combustion reactant intake port located passing through at least one of the said surfaces of said face ends; and at least one combustion product exhaust port located passing through at least one of the said surfaces of said face ends.

13. The engine of claim 12 wherein said cylinders have separate central axes spaced from each other.

14. A cylinder configuration for a piston and cylinder energy conversion device, such as an internal combustion engine, compressor or pump, comprising in combination:

at least two cylinders, each cylinder having a crank end and a face end;

said face ends adjacent each other;

each said cylinder having a substantially constant cross-sectional contour;

said face ends overlapping but offset from each other with an open cylinder connection pathway extending between said cylinders through said overlapping part of said face ends, and first and second end surfaces are provided for non-overlapping portions of said face ends, said first and second end surfaces separate from said cylinder connection pathway; and at least one piston located within each of said at least two cylinders and adapted to oscillate within one of said at least two cylinders in which said piston is located.

15. The cylinder configuration of claim 14 wherein said first surface at least partially faces one of said at least two cylinders and said second surface aces the other of said at least two cylinders, each of said at least two cylinders having a central axis extending centrally there through.

16. The cylinder configuration of claim 15 wherein each of said central axes, are oriented offset to each other.

17. The cylinder configuration of claim 16 wherein said at least two cylinders, combined diameter is greater than an offset distance between them.

18. The cylinder configuration of claim 14 wherein said first and second end surfaces include fuel, air and exhaust ports thereon, at said cylinder configuration is part of an internal combustion engine.

19. An internal combustion engine, comprising in combination:

at least two cylinders, each said cylinder having separate crank ends, separate face ends and separate central axes;

said separate face ends located closer to each other than a distance between said separate crank ends;

said face ends of said at least two cylinders having an open cylinder connection pathway there between;

at least two pistons, one piston located in each of said at least two cylinders;

each said piston configured to reciprocate within one of said cylinders;

wherein said separate central axes of said at least two cylinders are oriented offset from each other;

wherein said separate central axes are oriented substantially parallel to each other; and wherein said face ends of each of said at least two cylinders include surfaces thereon on portions thereof which are not defined by said open cylinder connection pathway, said surfaces including a first surface facing one of said at least two cylinders and a second surface facing the other of said at least two cylinders.

20. The engine of claim 19 wherein said surfaces includes means to enter fuel and air into an enclosure defined by said at least two cylinders together; and wherein said surfaces includes means to remove exhaust gases out of said enclosure.

* * * * *